US007300338B2

(12) United States Patent
Wielonski et al.

(10) Patent No.: US 7,300,338 B2
(45) Date of Patent: Nov. 27, 2007

(54) CMP DIAMOND CONDITIONING DISK

(75) Inventors: Roy F. Wielonski, Worthington, OH (US); Loyal M. Peterman, Jr., Dublin, OH (US)

(73) Assignee: Abrasive Technology, Inc., Lewis Center, OH (US)

( * ) Notice: Subject to any disclaimer, the term of this patent is extended or adjusted under 35 U.S.C. 154(b) by 0 days.

(21) Appl. No.: 11/508,654

(22) Filed: Aug. 23, 2006

(65) Prior Publication Data

US 2007/0066194 A1 Mar. 22, 2007

Related U.S. Application Data

(60) Provisional application No. 60/719,389, filed on Sep. 22, 2005.

(51) Int. Cl.
*B24B 1/00* (2006.01)

(52) U.S. Cl. ..... 451/443; 451/56; 451/72; 451/533; 51/295

(58) Field of Classification Search ..... 451/443, 451/56, 72, 533, 539; 29/423, 460; 51/295
See application file for complete search history.

(56) References Cited

U.S. PATENT DOCUMENTS 5,152,810 A * 10/1992 Rue et al. ..... 51/309
5,492,771 A * 2/1996 Lowder et al. ..... 428/565
6,368,198 B1 4/2002 Sung et al.
6,517,424 B2 2/2003 Wielonski et al.
6,702,654 B2 * 3/2004 Nanda et al. ..... 451/56

FOREIGN PATENT DOCUMENTS

WO WO2004086477 10/2004

* cited by examiner

*Primary Examiner*—Lee D. Wilson
*Assistant Examiner*—Anthony Ojini
(74) *Attorney, Agent, or Firm*—Jason H. Foster; Kremblas, Foster, Phillips & Pollick

(57) ABSTRACT

A method of making and the resulting non-metallic CMP conditioning pad comprising a non-metallic substrate and a single layer of abrasive particles bonded to the substrate by a non-metallic bonding medium. Preferred substrates include aluminum oxide and graphite. A bonding system employing finely powdered aluminum oxide particles mixed with a suitable adhesive is employed to bond the abrasive layer to the aluminum oxide substrate. Silicon carbide particles mixed into a compatible adhesive carrier including a polymer composition is preferred for bonding the abrasive particle layer to a graphite or carbide substrate.

18 Claims, 1 Drawing Sheet

CMP DIAMOND CONDITIONING DISK

CROSS-REFERENCES TO RELATED APPLICATIONS

This application claims benefit to U.S. Provisional Application No. 60/719,389 filed Sep. 22, 2005.

STATEMENT REGARDING FEDERALLY-SPONSERED RESEARCH AND DEVELOPMENT

Not Applicable

REFERENCE TO AN APPENDIX

Not Applicable

BACKGROUND OF THE INVENTION

1. Field of the Invention

This invention relates generally to methods and apparatus related to the polishing of workpieces, such as semi-conductor wafers, and particularly to an improved pad or disk for conditioning and restoring polishing pads used in such methods.

2. Description of the Related Art

The production of integrated circuits involves the manufacture of high quality semiconductor wafers. As well known in this industry, a high precision, flat or planar surface is required on at least one side of the wafer to assure appropriate performance objectives are attained. As the size of the circuit components decrease and the complexity of the microstructures involved increase, the requirement for high precision surface qualities of the wafer increases.

In order to meet this need, the polishing pads typically used in the industry require re-conditioning to restore their original configuration after a period of use so that the pad may continue to be used to provide the desired surface on the wafers. The chemical, mechanical planarization or polishing processes and apparatus used are well known. Reference to prior Holzapfel et al. U.S. Pat. No. 4,805,348 issued February, 1989; Arai et al. U.S. Pat. No. 5,099,614 issued March, 1992; Karlsrud et al. U.S. Pat. No. 5,329,732 issued July, 1994; Karlsrud et al. U.S. Pat. No. 5,498,196 issued March, 1996; Karlsrud et al. U.S. Pat. No. 5,498,199 issued March, 1996; Cesna et al. U.S. Pat. No. 5,486,131 issued January, 1996; and Holzapfel et al. U.S. Pat. No. 5,842,912 issued Dec. 1, 1998, provide a broad discussion of chemical, mechanical planarization referred to herein and in the industry as CMP processes.

During the polishing or planarization process of the semiconductor wafers, the polishing pad is rotated against the wafer in the presence of an abrasive slurry. The polishing pad generally used comprises a blown polyurethane-based material such as the IC and GS series of pads available from Rodel Products Corporation located in Scottsdale, Ariz. The hardness and density of the polishing pads depends upon the material of the workpiece (semiconductor wafer) that is to be polished.

During the CMP process, the chemical components of the abrasive slurry used tend to react with one or more particular materials on the wafer being polished and aid the abrasive in the slurry to remove portions of this material from the surface. During continued use of the polishing pad in this process, the rate of material removal from the wafer gradually decreases due to what is referred to in this field as "pad glazing". Additionally, with continued use, the surface of the polishing pad likely experiences uneven wear which results in undesirable surface irregularities. Therefore it is considered necessary to condition (true and dress) the polishing pad to restore it to a desirable operating condition by exposing the pad to a pad conditioning disk having suitable cutting elements. This truing and dressing of the pad may be accomplished during the wafer polishing process (in-situ conditioning) such as described in U.S. Pat. No. 5,569,062 issued on Oct. 29, 1996 to Karlsrud. However, such conditioning may also be done between polishing steps (ex-situ conditioning) such as described in U.S. Pat. No. 5,486,131 issued on Jan. 23, 1996 to Cesna et al., both of these patents being incorporated by reference herein.

Appropriate conditioning of the polishing pad is essential to restore the appropriate frictional coefficient of the pad surface and to allow effective transport of the polishing slurry to the wafer surfaces in order to obtain the most effective and precise planarization of the semiconductor wafer surface being polished.

The pad conditioner typically employed comprises a stainless steel disk coated with a monolayer of abrasive particles. Typically diamond particles or cubic boron nitride particles are preferred. These superabrasive particles may be secured to the conditioning disk by electroplating or by a brazing process. The braze bond has become more preferred due to forming a stronger bond between the diamond particles and substrate such that the diamond particles are less likely to loosen and fall free compared to electroplated conditioning disks. If such loose abrasive particles become embedded in the polishing pad or otherwise exposed to the wafer being polished, serious deformations in the wafer surface may occur such that the wafer becomes unusable and represent a loss of many thousands of dollars of time and labor.

Conditioning disks employing a monolayer of braze bonded diamonds, such as manufactured by Abrasive Technology, Inc. of Lewis Center, Ohio, have been recognized as very effective and an improvement over prior art conditioning disks using other bonding mediums, particularly in resisting premature loss of diamond abrasive particles. However, the corrosive nature of the polishing slurries currently used and the nature of even more aggressively corrosive slurry compositions which may be deemed more desirable for the CMP processes, present a problem which tends to shorten the useful life of even such braze bonded conditioning disks. These highly acidic polishing slurries attack the metallic bonding medium and the metal substrate. This action tends to cause premature loss of superabrasive particles and the undesirable effect resulting therefrom. This tendency has led those skilled in this art to employ various coatings over the superabrasive particles and the metallic bonding medium and/or the substrate. Some prior attempts of this nature are disclosed in U.S. Pat. No. 6,517,424 and in some of the cited references noted therein, each being incorporated by reference. However, the CMP industry has not fully accepted this solution, and a more satisfactory solution has eluded those of ordinary skill in the art.

BRIEF SUMMARY OF THE INVENTION

The present invention relates to an improved CMP polishing pad conditioning disk and method of making the same which has improved characteristics for resisting highly corrosive acidic polishing slurries presently used in CMP processing of high quality wafers used in the making of integrated circuits.

The polishing pad conditioning disk constructed in accordance with the present invention comprises a non-metallic substrate, a monolayer of natural or synthetic superabrasive particles distributed in a structured or random pattern on the surface of the substrate and securely bonded to a non-metallic substrate by a non-metallic bonding material.

Preferably a plastic or other suitable non-metal holder for the non-metallic disk is included and adapted to fit the CMP polishing machine in a conventional manner.

In general, the method of the present invention comprises the steps of forming a disk shaped substrate of a non-metallic material such as, for example, ceramic, carbon or carbon composite, or a suitable polymer or combination thereof. The surface of the disk which receives the abrasive monolayer is cleaned and coated with a compatible adhesive in liquid form when a ceramic bonding system is employed. Then the surface of the disk is covered with a ceramic bonding composition. A monolayer of superabrasive particles is applied in a structured or random pattern over the layer of bonding material using any well-known conventional technique. Then the coated disk is fired in an air oven to its firing temperature. After firing, a thin overcoat of the ceramic bonding composition may be optionally applied over the disk, with any excess covering the diamond layer removed by placing an absorbent sheet of material over the surface of the diamond particles. If this optional second coating is employed, the assembly is again fired as described above.

In another embodiment of the present invention, a graphite disk of the desired size is provided. A coating of a commercially available mixture of a silicon carbide and a polymer having adhesive properties is applied over the surface of the graphite disk to prepare the surface to receive a coating of a bonding mixture of silicon carbide powder and a suitable polymer which forms a gel or viscous liquid. Prior to applying the bonding mixture, the disk and initial coating is placed in a vacuum dessicator in a series of steps.

Then a second coating of the adhesive mixture is applied over the surface of the bonding mixture and a monolayer of superabrasive particles are applied over the surface. The adhesive mixture is allowed to air dry and then the assembly is placed in a furnace having a hydrogen or inert atmosphere and cured in successive stages up to a temperature of about 1500 degrees F.

Therefore it is an object with the present invention to provide an improved conditioning disk useful to restore CMP polishing pads which include a securely held monolayer of superabrasive particles mounted on a non-metallic substrate by a non-metallic bonding system.

It is another object of the present invention to provide a CMP conditioning disk of the type described which has an improved ability to resist corrosion by highly acidic polishing slurries such as currently used in prior and current CMP polishing processes.

It is a further object of the present invention to provide a method of manufacturing a CMP conditioning disk of the type described in an efficient manner at a cost at least equal to or less than the prior art CMP conditioning disks which employ a metallic substrate and metallic bonding systems.

Figure 2:
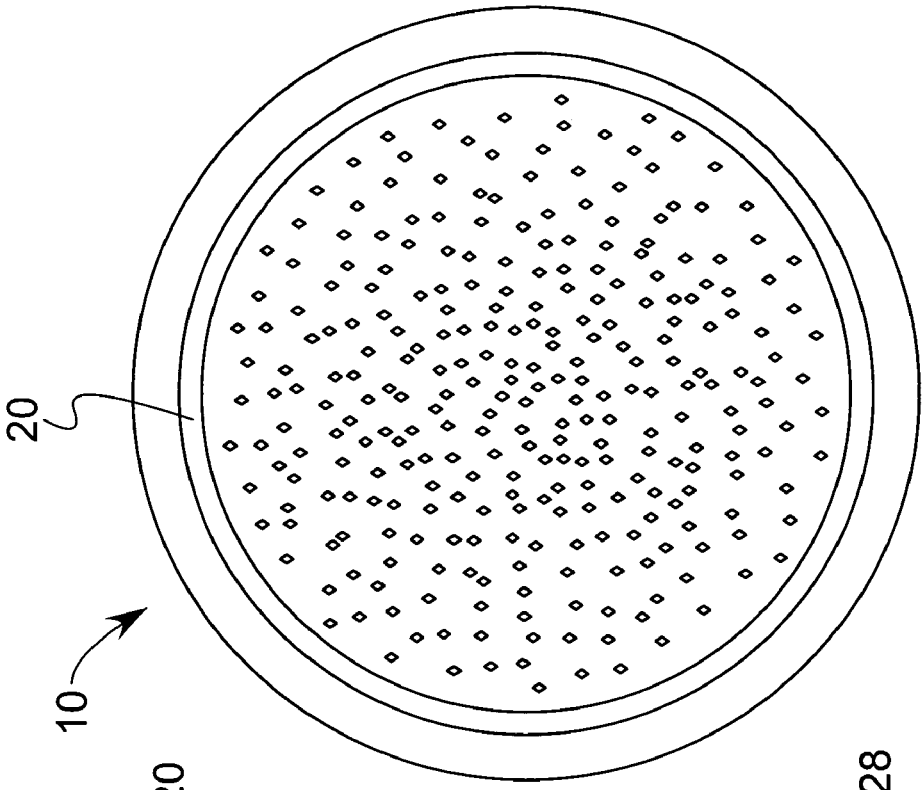
FIG. 2 is a top plan view of the disk assembly shown in FIG. 1.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Figure 1:
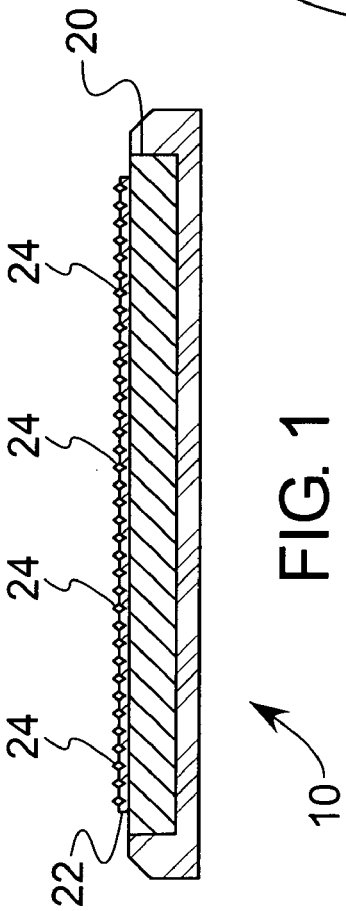
FIG. 1 is a side view in cross-section of a CMP conditioning disk made in accordance with the present invention.
Figure 3:
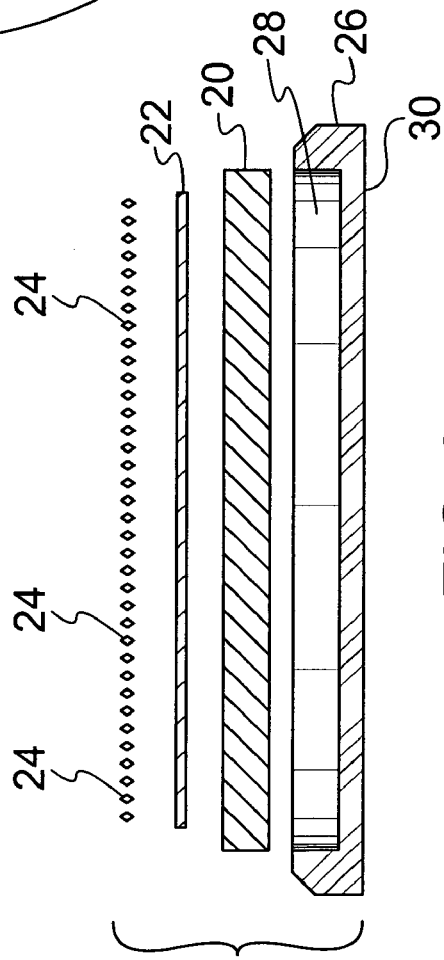
FIG. 3 is a side sectional exploded view illustrating the components of the disk assembly shown in FIG. 1.

As illustrated in FIGS. 1-3, a CMP polishing disk, indicated generally at 10, made in accordance with the present invention includes a disk-shaped substrate 20, a non-metallic bonding layer 22 and a monolayer of superabrasive particles such as at 24, distributed and bonded over the surface of the disk-shaped substrate 20.

A suitable holder 26 is adapted to receive the substrate 20 in a supported position and to fit on a conventional CMP polishing machine in a conventional manner. Holder 26 preferably comprises a non-metallic material such as, for example, a suitable plastic. Disk 20 is received in close-fit relationship within the recess 28 of holder 26 and may be securely adhesively bonded to holder 26 using one of many suitable adhesive bonding materials in a well-known manner.

The surface 30 of holder 26 opposite the surface holding the bonded abrasive layer may include suitable means for conventionally attaching the holder 26 to a conventional CMP polishing means. Often such means are a plurality of threaded holes (not shown), however, the particular attaching means do not form a part of the present invention and may be of any conventional form adapted to the particular CMP polishing machine used by the wafer manufacturer.

Further, the particular form of the conditioning disk shown may be usefully employed in well-known CMP polishing apparatus and methods such as described in several of the prior patents cited earlier herein. However, other conventional designs of such a conditioning disk useful in various forms of conventional CMP polishing apparatus may also be employed using the teachings of the present invention. The present invention primarily relates to the material employed in the substrate and bonding medium used to secure the diamonds or other superabrasive particles upon the working surfaces of the disk. The particulars of the general shape or form of the substrate surface and the pattern of those portions covered by abrasive particles may be continuous or interrupted as may be deemed desirable by the user without departing from the spirit of the present invention. Examples of such different forms of disks are shown in U.S. Pat. No. 6,517,424, which is incorporated herein by reference, among other prior patents.

In one preferred embodiment of the present invention, the substrate 20 may comprise a conventional fired or sintered aluminum oxide ceramic composition having a planar surface upon which the preferred diamond abrasive particles 24 are distributed in the desired array and securely mounted to the substrate surface by bonding layer 22. One preferred composition for bonding layer 22 in this embodiment comprises an aluminum oxide powder and a binder. One commercially available composition of the type is Aremco 503-VFG available from Aremco Products, Inc., in Valley Cottage, N.Y. The aluminum oxide powder has a size range of 1-5 microns in diameter. This bonding composition employs an adhesive binder of proprietary composition which is also commercially sold separately under the trade name Aremco 618-N Thinner.

In the commercial form sold, Aremco 503-VFG ceramic bonding composition may be applied onto the surface of substrate 20. The Aremco 618-N Thinner may be added to dilute the bonding composition or to render the original bonding composition less viscous for the application of the bonding composition by spreading, brushing or spraying, or the like, upon the surface as may be deemed most desirable.

The diamond abrasive particles, typically in a size range of between about 20 to 600 U.S. mesh, are distributed over the surface in any conventional manner, well-known to those of ordinary skill. The application of the abrasive particles is performed to achieve a monolayer of abrasive particles over the chosen working area of the layer 22. In the embodiment shown, essentially the entire surface is covered. However, other patterned forms or arrays of the abrasive particles may be used.

Typically, the abrasive particles may then be pressed into the bonding layer 22 using a flat plate, or the like, to achieve a relatively uniform height of the abrasive particles above the surface of the substrate. Then the assembly formed is air dried, fired in an air oven in stages up to a temperature of about 1000 degrees F. At or about this temperature, it has been determined that the full strength of the bonding composition of layer 22 is achieved.

High temperature sintering (about or above 2000 degrees F.) would achieve maximum density of the bonding composition of layer 22. However, this high temperature should be avoided. At such temperatures, the diamond particles would be compromised and begin to crack and/or decompose. Since the maximum strength of the ceramic bonding layer described in this embodiment is achieved at approximately 1000 degrees F., sintering, which is done in an air environment, is not mandatory to obtain a sufficiently secure bond between the substrate, bonding layer and diamond particles for the present CMP application.

In another preferred embodiment, a silicon carbide bonding composition may be employed with a graphite or silicon carbide substrate. The basic steps and procedure employed are similar to those used in the aluminum oxide embodiment described above. The curing procedure is different in view of the different characteristics of the silicon carbide composition.

Useful compositions for this embodiment are commercially available from Starfire Systems, Inc., Malta, N.Y., and include a series of products sold under the trade names SP Matrix Polymer and MS 42B and MS 10. It is very important to mix the MS 10 and MS 42B materials very well, as the silicon carbide material will separate from the carrier material, and use the mixture without undue delay. Also, it is highly recommended to follow Starfire Systems, Inc.'s safety instructions for handling this material. Preferably an initial coating of MS 10 is applied over the surface of a graphite substrate. This coating may be brushed on with a fine bristle artist brush leaving a wet film of the MS 10 material. The substrate and coating are then placed in a vacuum dessicator. The dessicator is evacuated and held under vacuum for several minutes. During this time trapped air is released from the coating and from the carbon surface. The dessicator is then pressurized to atmosphere. The purpose of this process is to force the polymer liquid into pores of the surface. Preferably this process is repeated two more cycles for a total of three cycles. The coated substrate will look dry following the previous cycling process. Next a sufficient coating of a powdered silicon carbide polymer composition, such as MS 42B, is applied over the same surface pre-wetted with MS 10. Immediately after this step, a monolayer of diamond abrasive particles is applied using standard well-known techniques. The substrate with diamond and MS 42B is then air dried for at least 1 to 2 hours. Another coating of MS 10 may be brushed on the diamond to fill in any voids. The assembly is then cured in a hydrogen atmosphere furnace in a series of rising temperature steps following Starfire System's literature for curing. The peak temperature is approximately 1500 degrees F. Then the assembly is allowed to cool. The cooling cycle should not be so rapid to permit cracking of the bonding system which may occur if the cooling rate is too fast. After cooling, the assembly is removed and cooled to room temperature and the curing is complete. As noted in the aluminum oxide embodiment, full sintering of the silicon carbide composition was found not to be necessary to obtain a cured silicon carbide bond strongly securing the monolayer of diamond particles to the substrate sufficiently to avoid premature loss of the abrasive particles during the typical CMP conditioning cycle.

Equivalent silicon carbide compositions useful in the present invention are commercially available from KION Corporation of Huntington Valley, Penn., among others. Additional commercial suppliers of suitable aluminum oxide bonding compositions are also well-known to those skilled in the art.

EXAMPLE I

A non-metallic CMP polishing disk was made employing a disk comprising aluminum oxide. One major planar surface of the disk was prepared by masking an outer portion of the disk with a tape extending inwardly approximately 0.100 inches from the outside perimeter edge. Then a layer of 618-N Aremco Thinner was applied to this major surface prior to applying a liberal layer of Aremco 503-VFG aluminum oxide cement which was then troweled to produce a relatively uniform layer of the cement over the surface of the disk.

To assure good adhesion of the abrasive particles over this layer of aluminum oxide cement, a thin layer of a mixture comprising 60% water and 40% Aremco 618-N Thinner was then air-brushed over the layer of cement.

Next a single layer of diamond abrasive particles applied over the disk surface covered by the aluminum oxide layer using a standard, well-known technique to assure the desired coverage of a single layer is achieved. In this example, the size of the diamond particles were in the range of between about 139 to 151 microns. The assembly was then air-brushed with water and the narrow strip was removed from the outer surface of the disk. The assembly was then permitted to air dry prior to pressing the diamond particles downwardly to partially embed them into the cement layer. A flat, ground surface of a steel plate was used to press the diamond particles into the cement such that the height of the diamond particles above the bonding layer was very close to equal.

Another thin layer of diluted Aremco Thinner was applied (60% water—40% Aremco 618-N Thinner), and the assembly was permitted to thoroughly dry. If deemed desirable, this drying step may be aided by placing the assembly in an oven at about 190 degrees for one to two hours.

After drying is achieved, the assembly was fired in a conventional furnace for one hour at a peak temperature of about 1000 degrees F.

The resulting non-metallic disk was tested by an outside commercial testing company, Entrepix, Inc., using a standard CMP tool platform on a series of standardized wafers to determine removal rate and non-uniformity of a conventional chemical-mechanical polishing pad. The test results indicated this non-metallic disk performed within satisfactory standards determined using conventional, commercially available metallic CMP conditioning disks.

Applicant's own in-housing indicated very satisfactory performance of disks made comparable to the one described above relatively to abrasive particle retention and resistance of both the non-metallic substrate and bonding medium in highly corrosive acid slurries currently used in CMP conditioning processes.

An aluminum oxide substrate with diamond bonded with aluminum oxide bonding system according to Example I, was tested for chemical resistance effectiveness. Testing was performed to establish chemical resistance of the non-metallic CMP disk. A Cerium oxide slurry (Cabot Microelectronics Si Lect 6000) was used as the chemical solution for the immersion testing of various disks including metallic nickel brazed diamond products and CMP disks bonded by electroplated nickel. The disks were immersed into the solution for 72 hours. The results of this test indicate that the non-metallic CMP disk was not affected by the cerium oxide material and the metallic bonded disk were generally degraded to an unacceptable degree.

An aluminum oxide substrate with diamond bonded CMP disk using the aluminum oxide bonding process described earlier herein was tested on a platform which rotated the diamond bonded to a non-metallic CMP disk against a conventional polymer conditioning pad to simulate actual use in the CMP process.

Such conditioning tests were run for a total of 27 hours in which the non-metallic CMP disk's diamond surface was forced to wear against a polymer pad for a total of 27 hours. No failure was noticed of either the bond material or diamond particles in any significant amount and appeared to be essentially at least equivalent in this respect to prior art metallic bonded CMP conditioner pads.

While certain preferred embodiments of the present invention have been disclosed in detail, it is to be understood that various modifications may be adopted without departing from the spirit of the invention or scope of the following claims.

The invention claimed is:

1. A conditioning tool for restoring a used CMP polishing pad to an operable condition comprising:

(a) a non-metallic substrate having a planar working surface; and (b) a monolayer of superabrasive particles bonded to the planar surface of said substrate by a layer of a non-metallic, non-vitreous bonding composition resistant to acidic polishing slurries.

2. The conditioning tool defined in claim 1 wherein said bonding composition includes aluminum oxide.

3. The conditioning tool defined in claim 1 wherein said bonding composition comprises silicon carbide.

4. The conditioning tool in accordance with claim 1 wherein said non-metallic bonding composition is not fully sintered.

5. The conditioning tool in accordance with claim 1 wherein said non-metallic bonding composition includes aluminum oxide and the substrate comprises aluminum oxide.

6. The conditioning tool in accordance with claim 1 wherein said bonding composition comprises silicon carbide and said substrate comprises graphite.

7. The conditioning tool in accordance with claim 1 wherein said bonding composition comprises silicon carbide and said substrate comprises aluminum oxide.

8. The conditioning tool in accordance with claim 1, wherein a portion of each of the superabrasive particles that is farthest from the substrate is spaced from a portion of the bonding composition layer that is farthest from the substrate, such that at least a portion of substantially all of the particles is uncoated by the bonding composition.

9. The conditioning tool in accordance with claim 8, wherein the height of the particles above the bonding layer is substantially equal.

10. A method of making a conditioning tool for restoring a used CMP polishing pad to an operable condition comprising:

(a) applying a layer of a non-metallic bonding composition to a planar working surface of a non-metallic substrate;

(b) applying a monolayer of superabrasive particles to the bonding composition layer; and (c) heating the substrate, bonding composition and particles to a peak temperature that is sufficient to form a bond resistant to acidic polishing slurries, and that is lower than necessary for fully sintering the bonding composition.

11. The method in accordance with claim 10, wherein the peak temperature is about 1,000 degrees Fahrenheit.

12. The method in accordance with claim 10, wherein the peak temperature is about 1,500 degrees Fahrenheit.

13. The method in accordance with claim 10, further comprising the step of pressing the particles to achieve a uniform height above the bonding layer.

14. The method in accordance with claim 10, wherein the substrate is aluminum oxide and the bonding composition is silicon carbide.

15. The method in accordance with claim 10, wherein the substrate is aluminum oxide and the bonding composition is aluminum oxide.

16. The method in accordance with claim 10, wherein the substrate is graphite and the bonding composition is aluminum oxide.

17. The method in accordance with claim 10, wherein the substrate is graphite and the bonding composition is silicon carbide.

18. The method in accordance with claim 10, wherein the heating step is carried out in air.

* * * * *